United States Patent [19]

Claassen et al.

[11] Patent Number: 4,949,953

[45] Date of Patent: Aug. 21, 1990

[54] DEVICE FOR STACKING SHEETS

[75] Inventors: Ernst Claassen, Goch; Jakob Bodewein, Düsseldorf; Henning Koss, Wuppertal; Rolf Kollan, Herten-Westerh., all of Fed. Rep. of Germany

[73] Assignee: Jagenberg Aktiengesellschaft, Dusseldorf, Fed. Rep. of Germany

[21] Appl. No.: 273,306

[22] Filed: Nov. 18, 1988

[30] Foreign Application Priority Data

Nov. 19, 1987 [DE] Fed. Rep. of Germany ..... 3739194

[51] Int. Cl.[5] ..... B65H 31/32; B65H 29/34

[52] U.S. Cl. ..... 271/218; 414/790.8; 414/796.1; 271/268

[58] Field of Search ..... 271/207, 189, 213, 214, 271/215, 217, 218, 219, 268; 414/789.5, 790.8, 796.1; 221/251

[56] References Cited

U.S. PATENT DOCUMENTS

| | | | |
|---|---|---|---|
| 2,770,392 | 11/1956 | Roberts | 221/251 X |
| 3,298,683 | 1/1967 | Stroud | 271/218 |
| 4,297,066 | 10/1981 | Romcke et al. | 271/218 X |
| 4,359,218 | 11/1982 | Karis | 414/790.8 X |
| 4,436,472 | 3/1984 | Kunzmann | 271/218 X |
| 4,647,265 | 3/1987 | Uno | 271/218 X |
| 4,662,816 | 5/1987 | Fabrig | 414/790.8 X |
| 4,796,879 | 1/1989 | Martini et al. | 271/218 |

FOREIGN PATENT DOCUMENTS

| | | | |
|---|---|---|---|
| 3616470 | 6/1987 | Fed. Rep. of Germany . | |
| 2157272 | 10/1985 | United Kingdom | 271/218 |

*Primary Examiner*—Joseph J. Rolla
*Assistant Examiner*—Edward S. Ammeen
*Attorney, Agent, or Firm*—Sprung Horn Kramer & Woods

[57] ABSTRACT

A device for stacking sheets, especially sheets of paper that arrive overlapped. The device has a layoff platform that can be raised and lowered, a separating mechanism that is positioned behind the stack, that can be raised and lowered, and that can be introduced into the vicinity of the top of the stack, especially between the uppermost sheet and the incoming stream of overlapping sheets, two compression jaws that are positioned at different heights at the rear of the stack, that can be raised and lowered, and that can be inserted into gaps created by the separating mechanism, and an auxiliary stacking platform that is positioned at the rear of the stack, that can be raised and lowered, and that can be introduced into the vicinity of the layoff platform immediately below the lower compression jaw. The object is to provide a device that is of particular advantage with respect to design. The two compression jaws (19 and 20) and the auxiliary stacking platform (21) are both accommodated in carrier (18) that can be raised and lowered by a vertical drive mechanism (23), whereby the downward motion of the carrier is synchronized with the downward motion of the layoff platform (2).

10 Claims, 6 Drawing Sheets

DEVICE FOR STACKING SHEETS

BACKGROUND OF THE INVENTION

The invention relates to a device for stacking sheets, especially sheets of paper that arrive overlapped.

A method of and device for replacing a stack of sheets without interrupting the supply of sheets to the stacking point is known from Application Ser. No. 938 206, now U.S. Pat. No. 4,796,897. The full stack can be replaced without losing any sheets and without the sheets being displaced during the replacement.

This device features means of conveying the overlapping sheets to a stacking point accommodating a layoff platform that can be raised and lowered. Behind each stack are a separating mechanism that travels up and down and consists of a pivoting arm with a sheet-metal separator on its free end, two compression jaws that are positioned at different levels and travel up and down and along the direction that the sheets are conveyed in, and an auxiliary stacking platform that can be both displaced along the direction that the sheets are conveyed in and lowered. The separating mechanism that moves up and down can be inserted between the rear edges of the sheets at the top of the stack, especially between the uppermost sheet on the stack and the stream of overlapping sheets. The separating mechanism and the compression jaws are in the form of laterally separated forks or grates, so that the compression jaws on the separating mechanism can travel between them.

When a stack is replaced, the compression jaws enter the gaps created by the separating mechanism between the rear edges of the sheets and compress a pack of sheets, whereas the auxiliary stacking platform is introduced or retracted. The upper part of the stack rests on the auxiliary stacking platform while the bottom part of the stack is removed.

The method of replacing a stack in accordance Application Ser. No. 938 206 also has other advantages.

Since the upper sheets of the stack being removed are preliminarily pressed down and hence have the air pressed out of them, the stack is ready to move without the uppermost sheets flying off.

The sheets can be stacked on a pallet with edges projecting from each side, so that, once protective corners have been added to the top, the stack can be secured on the pallet with straps without damaging the edges of the sheets.

Since the pack of sheets is secured stationary while the auxiliary stacking platform is being introduced and retracted, the sheets will not be mutually displaced in the vicinity of the platform and their lateral surfaces will remain straight.

OBJECT OF THE INVENTION

The object of the invention is to provide a device like the one disclosed in German OS 3 616 470 that is of particular advantage with respect to design.

This object is realized by modifying the indicated apparatus by providing a carrier for the compression jaws and the auxiliary stacking platform. The carrier can be raised or lowered by means of a vertical drive mechanism, whereby the downward motion of the carrier is synchronized with the downward motion of the layoff platform.

These characteristics make it possible to execute the up-and-down motions of the individual mechanisms involved in replacing the stack with the requisite precision and at a low investment.

In accordance with other features, the carrier can be alternately coupled to the mechanism that drives the layoff platform and to its own vertical drive mechanism. A spindle-driven mechanism may be provided for raising the layoff platform and lowering the carrier, not only ensuring precise control of the elevation of the layoff platform but also extensively preventing it from falling. A gimbaled suspension prevents spindle nuts from jamming on spindles, in consequence for example of the layoff platform buckling under the weight of the stack. Making the upper compression jaw capable of being raised and lowered eliminates the need to lift the edges of the sheets against their own weight in order to compress the pack of sheets.

Other advantageous embodiments of the invention that permit the separating mechanism to be smoothly introduced between the rear edges of the sheets include a separating mechanism that can be pivoted in between the rear edges of the sheets of paper while simultaneously being raised. Advantageously, the separating mechanism has several rigidly mounted sheetmetal separators distributed along a pivoting arm, the arm being articulated by an irregular double-rocker mechanism to a lateral component that can be raised and lowered. Coating the compression jaws with felt or a similar material prevents marking sheets of sensitive paper as may occur with metal surfaces.

BRIEF DESCRIPTION OF THE DRAWINGS

The invention will now be specified with reference to the simplified drawings, wherein.

DETAILED DESCRIPTION OF THE INVENTION

Figure 1:
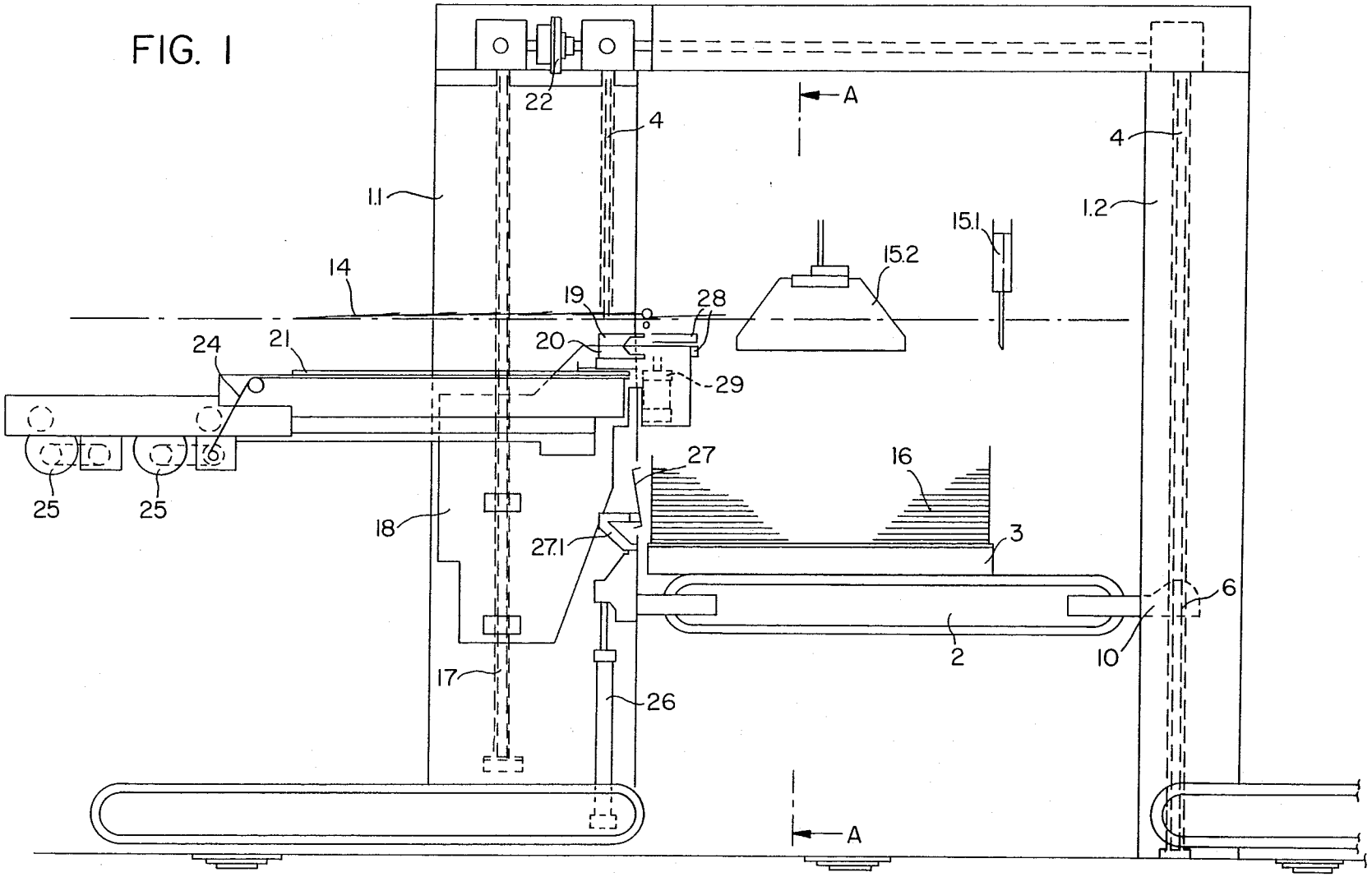
FIG. 1 is a longitudinal section through a device for stacking sheets in accordance with the invention.
Figure 2:
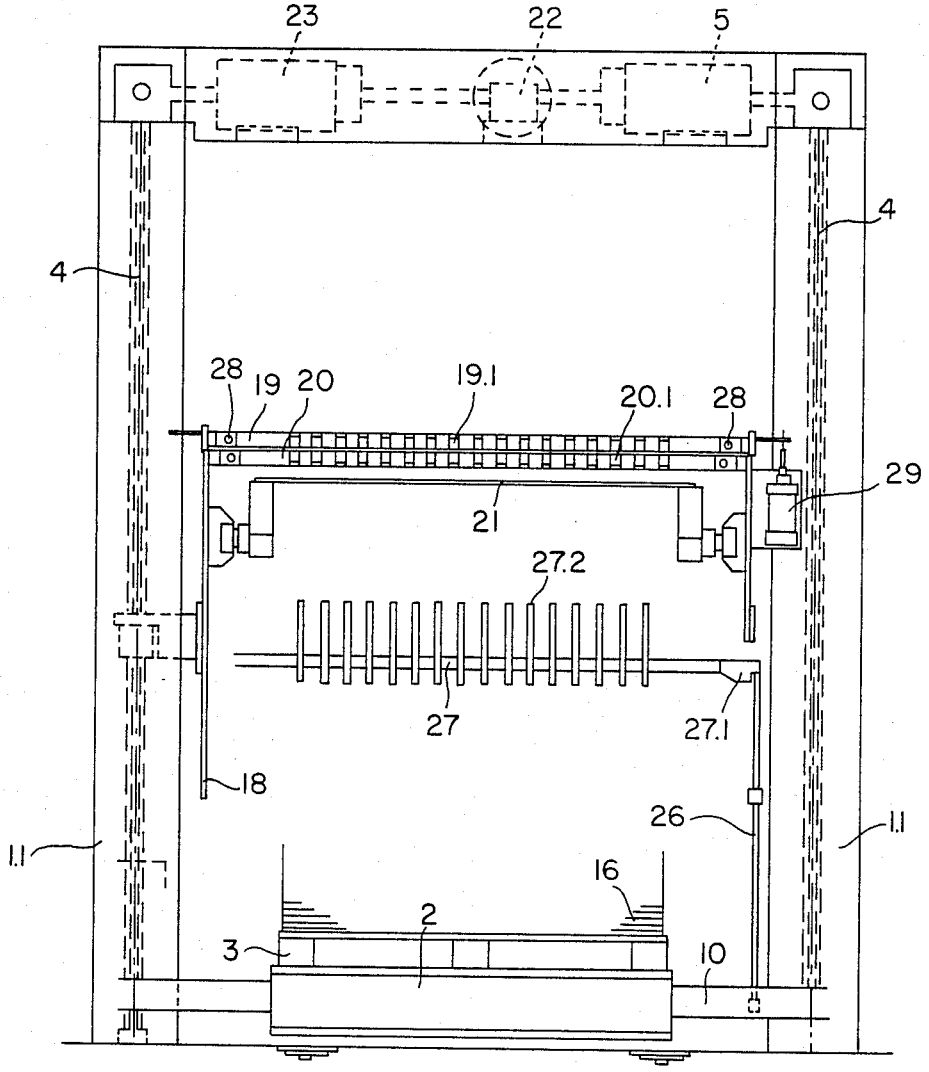
FIG. 2 is a transverse section along the line A—A in FIG. 1.
Figure 3:
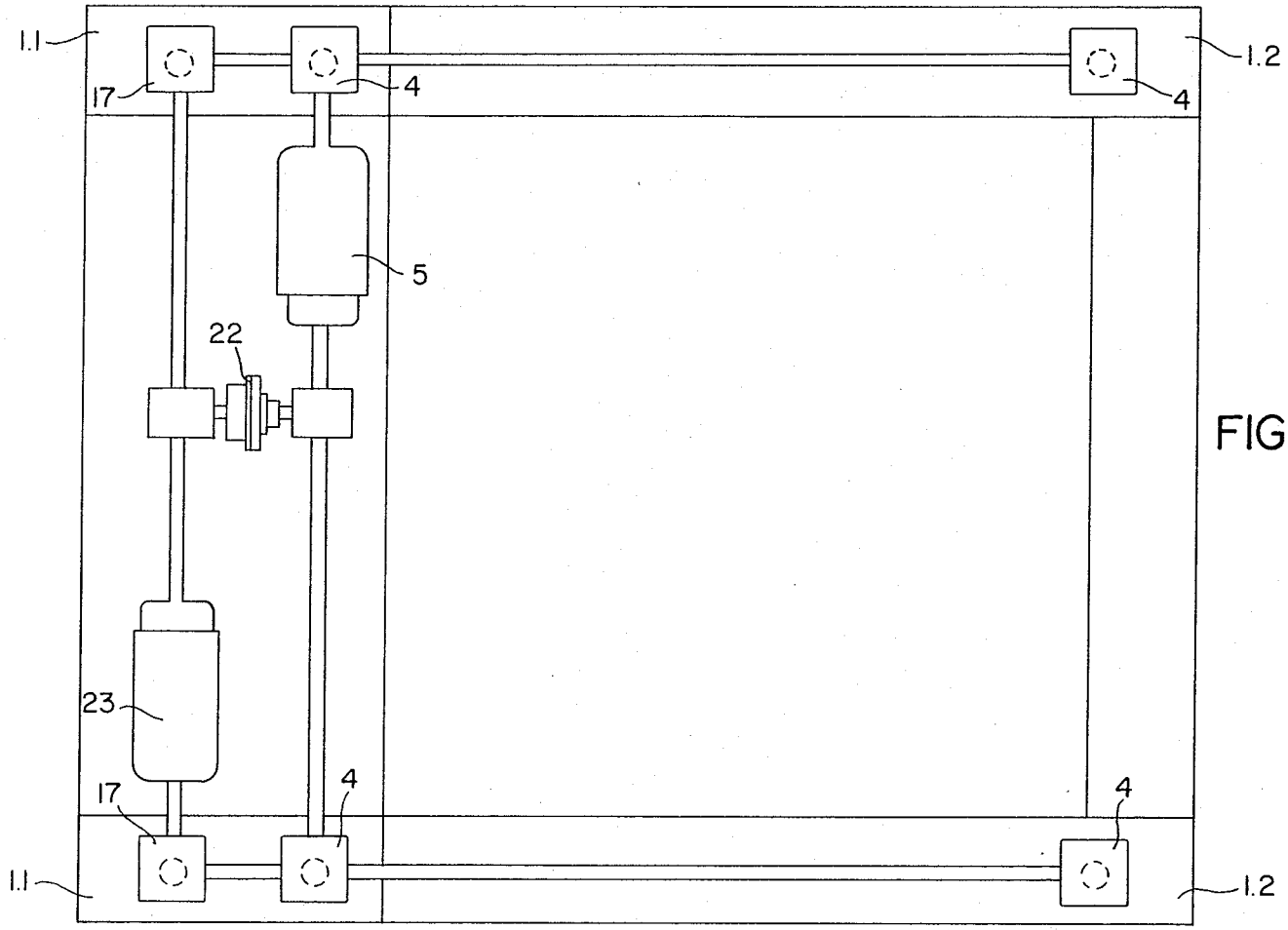
FIG. 3 is a top view of the vicinity of the stack.

The frame of the stacking device has four uprights 1.1 and 1.2 with a layoff platform 2 in the middle and equipped with a chain conveyor that travels in the direction that the sheets are conveyed. The conveyor moves pallets 3 with full stacks of paper on them out of the stacking area. Layoff platform 2 can be raised and lowered in the middle of uprights 1.1 and 1.2 by means of a spindle-driven lifting mechanism. The lifting mechanism consists of four vertical spindles 4 accommodated in uprights 1.1 and 1.2 and driven by a joint drive mechanism 5.

Figure 4:
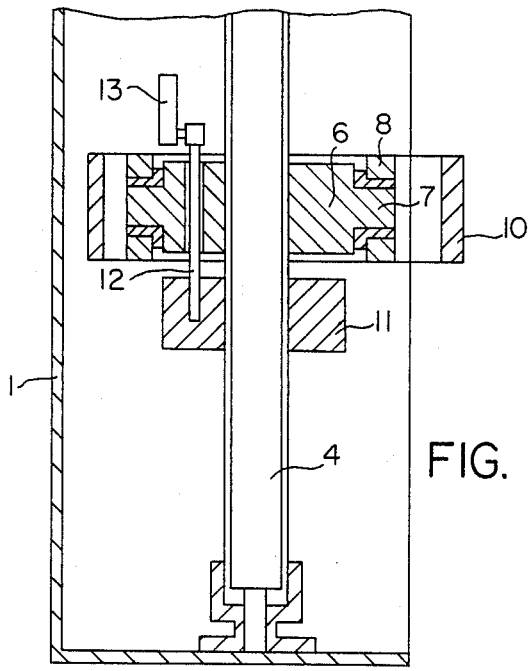
FIG. 4 is a vertical section through one suspension for the stack platform.
Figure 5:
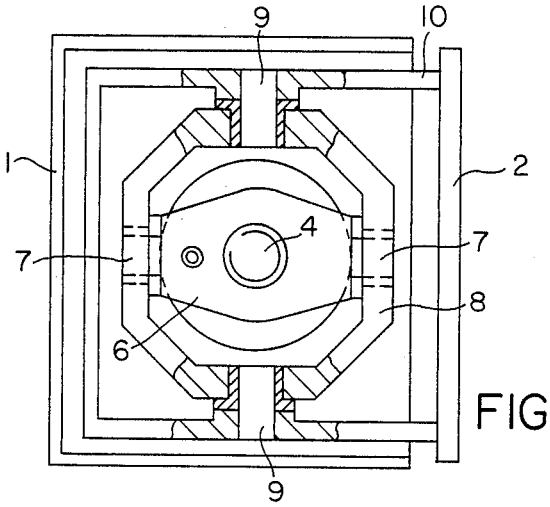
FIG. 5 is a horizontal section through the suspension.

Layoff platform 2 is secured to spindle nuts 6 by the gimbaled suspension illustrated in detail in FIGS. 4 and 5, which will now be specified.

On each spindle nut 6, an annular structure 8 is suspended from and rotates around two horizontal pins 7 coaxially secured to opposite sides and parallel to one side of layoff platform 2. Outside and on annular 19 structure 8, two horizontally opposed pins 9 are secured coaxially and perpendicular to pins 7. Suspended in such a way that it can rotate on pin 9 is a projecting section 10 of one corner of layoff platform 2. Projecting section 10 is secured to the platform, for the purpose of compensating for any reduction in length that occurs as the result of tilting, by unillustrated tie rods. A lock nut 11 is positioned below spindle nut 6 and connected to it by a bolt 12 that activates an emergency-stop limit switch 13 when the axial distance between nuts 6 and 11 becomes too short. The gimbaled suspension of layoff platform 2 prevents spindle nut 6 from tilting and accordingly becoming jammed on spindles 4.

The spindle-driven lifting mechanism can lift a pallet 3 into the vicinity of the system that supplies the stream 14 of overlapping sheets, which is a known conveyor belt that operates at a fixed elevation. Approximately on the same level as the conveyor belt and in the middle of uprights 1.1 and 1.2 are known layboys that precisely position a sheet on a stack 16. Layboys have a known stop 15.1, lateral baffles 15.2, jogging baffles, etc., capable of being displaced horizontally and across the direction that the sheets are conveyed in to adjust them to different sheet formats although operating at a fixed elevation.

Positioned in the two intake-end uprights 1.1, which are on the left-hand side in FIG. 1, is another vertical spindle 17 upstream of the spindles 4 on the layoff platform along the direction in which the sheets are conveyed. Positioned on spindles 17 is a carrier 18 that extends along the operating width and accommodates, from top to bottom, an upper compression jaw 19, a lower compression jaw 20, and an auxiliary stacking platform 21, each of which can move along the direction the sheets are conveyed in such that they can be independently introduced into and retracted from the vicinity of layoff platform 2. To make it possible to raise and lower carrier 18 on spindles 17, the spindles can be coupled to a separate drive mechanism 23 by a coupling 22. It is also possible to uncouple them from drive mechanism 23 and couple them to the mechanism 5 that drives the spindles 4 on layoff platform 2 in order to synchronize the vertical motions of carrier 18 and layoff platform 2.

Auxiliary stacking platform 21 consists of a shallow carriage that is revolved along the direction in which the sheets are conveyed by a low-friction blanket 24 and that can be displaced horizontally by a traveldrive mechanism 25. Its dimensions correspond to that of the largest sheet format that can be laid off.

Figure 6:
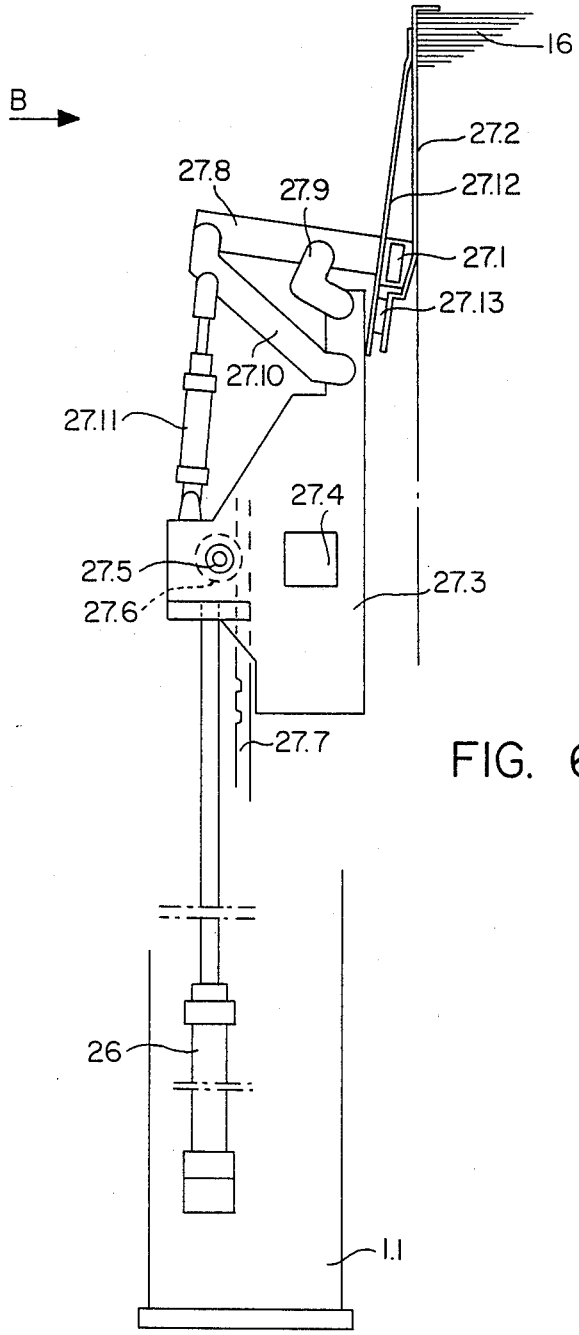
FIG. 6 is a larger-scale representation of the separating mechanism.
Figure 7:
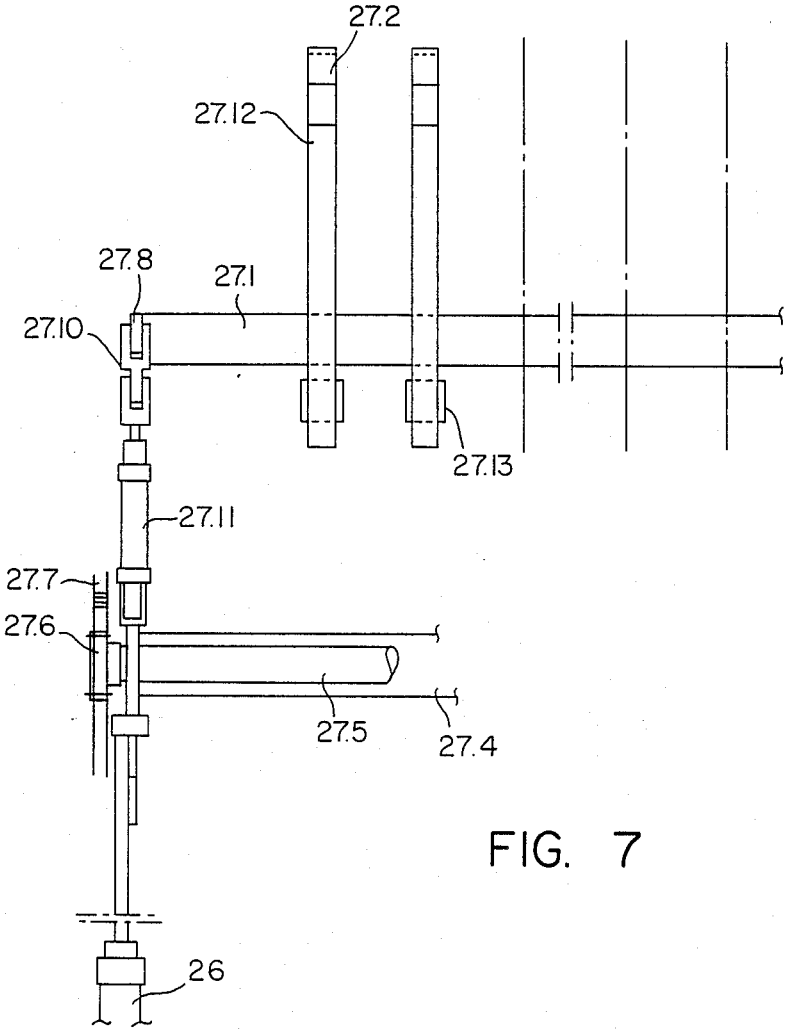
FIG. 7 is a top view along the direction that the sheets are conveyed in as indicated by arrow B in FIG. 6.

On the same side of stack 16 as carrier 18, the side that is in front of the stack along the direction in which the sheets are conveyed and that is usually called the rear of the stack because that is where the rear edges of the sheets are laid off, is a separating mechanism 27 that can be raised and lowered by means of two lateral vertical pneumatic cylinders 26. Separating mechanism 27 has sheet-metal separators 27.2 distributed along the operating width on pivoting arm 27.1. The ends of the separators are bent into fingers that can be pivoted in between the rear edges of the sheets in the vicinity of the stack. Separating mechanisms 27 can be raised into the vicinity of the supply system and lowered to below auxiliary stacking platform 21. Their design is illustrated in FIGS. 6 and 7 and will now be specified in detail.

Mounted on each intake-end upright 1.1 is a lateral component 27.3 that can be displaced up and down by pneumatic cylinders 26. Both lateral components 27.3 are connected by a transverse arm 27.4 and a synchronous shaft 27.5 to cogwheels 27.6 on the ends. Cogwheels 27.6 engage racks 27.7 on uprights 1.1, ensuring a precisely synchronized vertical displacement of both lateral components 27.3.

The pivoting arm 27.1 that extends over the operating width is articulated by way of an irregular double-rocker mechanism to the upper end of each lateral component 27.3. Each double rocker consists of a coupling member 27.8 to which the pivoting arm is rigidly secured and that is articulated to its associated lateral component 27.3 by two tie rods 27.9 and 27.10 of unequal length. The articulation of shorter tie rod 27.9 is located on lateral component coupling 27.3 vertically above the articulation of longer tie rod 27.10. Engaging each longer tie rod 27.10 is a pneumatic pivoting cylinder 27.11 that rests on its associated lateral component 27.3. This design results in a simultaneous upward displacement of pivoting arm 27.1 every time it pivots in toward stack 16.

Sheet-metal separators 27.2 are distributed along pivoting arm 27.1 and can be removed from it. They are secured by means of a supplemental sheet 27.12 of metal riveted at an acute angle to the rear of each sheet-metal separator 27.2 and with a magnet 27.13 attached to its end. The magnet attracts separator 27.2 and accordingly clamps pivoting arm 27.1 between the separator and the supplemental sheet of metal.

The two compression jaws 19 and 20 consist of horizontal and low-friction coated tongs 19.1 and 20.1 that are position adjacent and separate. Pneumatic cylinders 28 horizontally introduce compression jaws 19 and 20 independently approximately 10 cm into the vicinity of the stack and retract them therefrom. The coating is made of felt or a similar material and covers the total surface of tongs 19.1 and 20.1 that extends into stack 16. It is cemented to the tongs. The tongs are displaced in relation to the sheet metal separators 27.2 of separating mechanism 27 to prevent them from interfering with each other while they are being raised and lowered. Whereas lower compression jaw 20 is secured to carrier 18 at a fixed elevation directly above auxiliary stacking platform 21, compression jaw 19 can also be moved up and down by a bidirectional pneumatic cylinder 29 in order to grip the rear edges of the sheets of a pack between compression jaws 19 and 20.

The principle behind the operation of the device in accordance with the invention is thoroughly described in Application Ser. No. 938 206. The following is intended to supplement that description.

Between two stack changes and during a stack change, the vertical position of the top of the stack is constantly sensed by a measuring instrument and maintained constant by lifting the stack within a prescribed range. In so doing, the instrument governs either the mechanism 5 that drives layoff platform 2 or the mechanism 23 that drives carrier 18 as will now be specified.

Between two stack changes, carrier 18 is in its vertical ready position below the system that supplies the stream 14 of overlapping sheets. Compression jaws 19 and 20 and auxiliary stacking platform 21 are outside the vicinity of the stack. Pneumatic cylinder 29 holds upper compression jaw 19 up against a stop on upright 1.1. Separating mechanism 27 is in the ready position below auxiliary stacking platform 21. The stack-height measuring instrument maintains the top of the stack at a constant level by controlling the upward displacement of layoff platform 2. To initiate a change of stacks, separating mechanism 27 travels up, and the angled section of sheet-metal separator 27.2 pivots in between the rear edges of the sheets between the uppermost sheet on stack 16 and the stream 14 of overlapping sheets. Since the sheets are being supplied overlapped, meaning that each subsequent sheet is on top of its preceding sheet, sheet-metal separator 27.2 must be prevented from striking the rear edge of a sheet as it pivots in. This is attained by means of the simultaneous upward motion of the separator as it pivots in. The angled section of sheet-metal separator 27.2 is raised upstream of the vicinity of stack 16 to above the uppermost sheet on the stack, simultaneously lifting the latest sheet to be supplied. The result is a slight gap between the two sheets, allowing the angled section of sheet-metal separator 27.2 to rest on stack 16 without any problems.

Separating mechanism 27 is then moved down along with stack 16. It is halted at the level of lower compression jaw 20, creating a gap between the rear edges of the sheets, into which the jaw travels approximately 10 cm. The spindles 17 that carrier 18 is mounted on are simultaneously coupled to the mechanism 5 that drives layoff platform 2, raising the carrier at that precise instant in synchronization with layoff platform 2. Upper compression jaw 19 does not follow the upward motion because it is being maintained in its vertical position against the stop by pneumatic cylinder 29. Separating mechanism 27 is extracted from stack 16 and travels up again and in between the rear edges of the sheets to create another gap. Since layoff platform 2 has simultaneously traveled farther down, a distance of approximately 250 mm will be left between the two gaps. Once upper compression jaw 19 has entered the second gap, separating mechanism 27 is extracted from the stack and the pack is compressed between the compression jaws by lowering upper compression jaw 19. At this instant, spindles 17 are uncoupled from the mechanism 5 that drives layoff platform 2 and coupled to their own vertical drive mechanism 23. From this time on the height-detecting instrument will simultaneously control drive mechanism 23. The mechanism 5 that drives layoff platform 2 is accelerated to expand the gap between lower compression jaw 20 and the lower section of the stack. Auxiliary stacking platform 21 enters the expanded gap to support the upper section of the stack. The lower section of the stack is now accelerated downward and removed.

Once a fresh pallet 3 has been lifted to directly below auxiliary stacking platform 21, the platform is extracted from stack 16, and carrier 18 is recoupled to the mechanism 5 that drives layoff platform 2, which is again raised subject to the height-measuring instrument. Compression jaws 19 and 20 are opened and also extracted from stack 16. Since the upper edge of the rear of the stack drops when the compression jaws leave it, the downward motion of layoff platform 2 is briefly interrupted so that it can be raised to the extent that the edge drops, preventing the height from which the sheets drop onto stack 16 from increasing. Once compression jaws 19 and 20 have been extracted from the stack, carrier 18 is uncoupled from the mechanism 5 that drives layoff platform 2 and raised by its own drive mechanism 23 back into the vertical ready position until a new stack-exchange procedure is initiated.

The foregoing embodiment is designed for destacking relatively large-format sheets of paper with edges approximately 500 to approximately 2000 mm long, and stacks as high as 2000 mm can be produced. It is also possible to use it as a ream layboy, collecting into stacks and packing a desired number (e.g. 500 or 1000) of sheets.

It is understood that the specification and examples are illustrative but not limitative of the present invention and that other embodiments within the spirit and scope of the invention will suggest themselves to those skilled in the art.

What is claimed is:

1. In a device for stacking sheets, such as paper, that arrive overlapped, having a layoff platform with a mechanism for is raising and lowering, a separating mechanism positioned behind the stack, which can be raised and lowered, and which can be introduced into the vicinity of the top of the stack between the uppermost sheet and an incoming stream of overlapping sheets, two compression jaws positioned at different heights at the rear of the stack, which can be raised and lowered, and which can be inserted into gaps created by the separating mechanism, and an auxiliary stacking platform positioned at the rear of the stack, which can be raised and lowered, and which can be introduced into the vicinity of the layoff platform immediately below the lower compression jaw, the improvement which comprises a carrier for the two compression jaws and the auxiliary stacking platform, a vertical drive mechanism for the carrier, and means for synchronizing the downward motion of the carrier with the downward motion of the layoff platform.

2. A device according to claim 1, including means for alternately coupling the carrier to the mechanism that drives the layoff platform and to its own vertical drive mechanism.

3. A device according to claim 1, wherein the means for synchronizing comprises a spindle-driven mechanism for raising either or both the layoff platform and the carrier.

4. A device according to claim 3, wherein the mechanism includes spindle nuts and the layoff platform is secured to the spindle nuts by a gimbaled suspension.

5. A device according to claim 1, including means for raising and lowering the upper compression jaw in the carrier, but the elevation of the lower compression jaw is fixed.

6. A device according to claim 1, including means for raising and pivoting the separating mechanism, which means can be pivoted in between the rear edges of the sheets of paper while simultaneously being raised.

7. A device according to claim 6, wherein the separating mechanism has several rigidly mounted sheet-metal separators distributed along a pivoting arm, the arm being articulated by an irregular double-rocker mechanism to a lateral component that can be raised and lowered.

8. A device according to claim 7, including a cylinder mounted on the lateral component and pivoting the arm.

9. A device according to claim 7, wherein the sheet-metal separator is secured to the pivoting arm by magnets.

10. A device according to claim 1, wherein the compression jaws are tongs covered with felt-like material.

* * * * *